US011150575B2

(12) United States Patent
Deprez et al.

(10) Patent No.: US 11,150,575 B2
(45) Date of Patent: Oct. 19, 2021

(54) DIGITAL PRINTING APPARATUS AND PROCESS USING CURABLE DRY TONER

(71) Applicant: XEIKON MANUFACTURING N.V., Lier (BE)

(72) Inventors: Lode Erik Dries Deprez, Wachtebeke (BE); Werner Jozef Johan Op De Beeck, Putte (BE); Karlien Maria Hugo Renata Torfs, Boechout (BE); Maarten Marina E Vandenbergh, Berchem (BE)

(73) Assignee: XEIKON MANUFACTURING N.V., Lier (BE)

( * ) Notice: Subject to any disclaimer, the term of this patent is extended or adjusted under 35 U.S.C. 154(b) by 0 days.

(21) Appl. No.: 16/754,882

(22) PCT Filed: Oct. 25, 2018

(86) PCT No.: PCT/EP2018/079239

§ 371 (c)(1),
(2) Date: Apr. 9, 2020

(87) PCT Pub. No.: WO2019/081621

PCT Pub. Date: May 2, 2019

(65) Prior Publication Data

US 2020/0310289 A1 Oct. 1, 2020

(30) Foreign Application Priority Data

Oct. 27, 2017 (NL) ..... 2019819

(51) Int. Cl.
*G03G 15/08* (2006.01)
*G03G 15/20* (2006.01)

(52) U.S. Cl.
CPC ..... *G03G 15/0865* (2013.01); *G03G 15/2007* (2013.01); *G03G 15/2098* (2021.01)

(58) Field of Classification Search
USPC ..... 399/281
See application file for complete search history.

(56) References Cited

U.S. PATENT DOCUMENTS 8,182,875 B2 5/2012 Anderson et al.
2006/0148358 A1* 7/2006 Hall ..... B32B 5/08 442/328

(Continued)

FOREIGN PATENT DOCUMENTS

EP 1288724 A2 3/2003

OTHER PUBLICATIONS

International Search Report and Written Opinion for the International Patent Application No. PCT/EP2018/079239, dated Feb. 11, 2019, 12 pages.

*Primary Examiner* — Q Grainger
(74) *Attorney, Agent, or Firm* — Kacvinsky Daisak Bluni PLLC

(57) ABSTRACT

A digital printing process for xerography printing with curable dry toner. The process includes: forming a latent image as a pattern of electric charge on a surface of an imaging member; transferring dry toner onto a development member; developing the latent image by transferring dry toner from the development member onto the imaging member in accordance with the pattern; transferring the dry toner from the imaging member to a first substrate; applying a second substrate on the transferred dry toner, fusing the transferred dry toner, and bonding the second substrate to the first substrate. The fusing is done before and/or during and/or after the applying of the second substrate. After application of the second substrate, the dry toner is irradiated with actinic radiation or particle beams to cure at least the fused transferred dry toner. The irradiating is done after and/or during the fusing.

18 Claims, 4 Drawing Sheets

(56) References Cited

U.S. PATENT DOCUMENTS

| | | | | |
|---|---|---|---|---|
| 2006/0239729 | A1* | 10/2006 | Okamoto | G03G 9/08708 399/342 |
| 2011/0113976 | A1* | 5/2011 | Thompson | G03G 7/008 101/27 |
| 2016/0097996 | A1* | 4/2016 | Gilan | B44C 1/1729 101/227 |
| 2019/0146377 | A1* | 5/2019 | Deprez | G03G 15/6591 399/237 |

* cited by examiner

DIGITAL PRINTING APPARATUS AND PROCESS USING CURABLE DRY TONER

This is a national stage application filed under 35 U.S.C. § 371 of pending international application PCT/EP2018/079239, filed Oct. 25, 2018, which claims priority to Netherlands Patent application NL 2019819, filed Oct. 27, 2017, the entirety of which applications are hereby incorporated by reference herein.

FIELD OF INVENTION

The field of the invention relates to digital printing apparatus and processes using curable dry toner.

BACKGROUND

Prior art digital printing apparatus using dry toner typically comprise an image forming unit with an imaging member adapted to sustain a pattern of electric charge forming a latent image on its surface, a development member arranged to receive dry toner, and to develop said latent image by transferring a portion of said dry toner onto the imaging member in accordance with said pattern. The dry toner is then applied from the imaging member on the substrate, optionally via an intermediate member. Afterwards the developed latent image is fused on this substrate. In such methods curable dry toner particles may be used. Dry toner particles are basically polymeric particles comprising a polymeric resin as a main component and various ingredients mixed with said toner resin. Apart from colourless toners, which are used e.g. for finishing function, the toner particles comprise at least one black and/or colouring substance, e.g., coloured pigment. Examples of such dry toners are described in European patents EP 1 756 675 B1, EP 1 930 780 B1, EP 2 019 340 B1, and PCT/EP2017/059697 in the name of the Applicant, which are included herein by reference.

It is known to apply coatings on printed toner images to reduce the sensitivity to rubbing and/or to improve the gloss. However, such embodiments have the disadvantage that a separate coating station is required downstream of the printing station.

SUMMARY

The object of embodiments of the invention is to provide a digital printing process and apparatus with improved printing results for various types of substrates, such as flexible substrates (e.g. in pouches) or labels used in the (food) packaging industry.

According to a first aspect there is provided a digital printing process for xerography printing with dry toner. The process comprises the following steps: forming a latent image as a pattern of electric charge on a surface of an imaging member; transferring dry toner onto a development member; developing the latent image by transferring dry toner from the development member onto the imaging member in accordance with the pattern; transferring the dry toner from the imaging member to a first substrate; applying a second substrate on the transferred dry toner and fusing the transferred dry toner, wherein the fusing may be done before and/or during and/or after the applying of the second substrate, and bonding the second substrate to the first substrate; and, after application of the second substrate, irradiating the dry toner with actinic radiation or particle beams to cure the dry toner. The irradiating is done after the fusing, or the irradiating may be done during the fusing when the fusing is performed after the application of the second substrate.

The bonding of the second substrate to the first substrate may be caused by heat and/or pressure and/or actinic radiation, or in any other suitable manner, preferably during the applying of the second substrate and/or during the fusing and/or during the irradiating. Preferably at least the curing is done when the toner is above the glass transition temperature Tg.

Applying a second substrate on the transferred dry toner on the first substrate before curing the dry toner, has a number of advantages. First, during the irradiating with actinic radiation or particle beams, the dry toner is trapped between the first and the second substrate, such that it is substantially sealed from the atmosphere. In that manner the curing can take place under substantially oxygen and water free conditions. In certain embodiments, the first and second substrates may be such that no oxygen can pass through the substrates. Also, applying the second substrate may yield in a slight smoothening of the upper surface of the printed product. Further, by embedding the cured dry toner layer between the first and second bonded substrates, the printed image may be better protected and/or the gloss may be improved. More in particular, the resulting printed product may be less sensitive to rubbing, may have a reduced sensitivity towards solvents and sunlight, and may have a smoother surface with an improved gloss. Additionally the inventors have observed that the internal cohesion of the fused toner material is not noticeably changed during the fusing (without curing) when linear or slightly crosslinked polymers are used. Because of the low internal cohesion, the force needed to pull a first substrate from a second substrate by splitting within the toner layer is rather low. In embodiments of the inventions, thanks to the use of a curable dry toner which is cured after the applying of the second substrate, the internal cohesion is significantly improved when the curing is performed after or during the fusing.

In preferred embodiments the obtained sandwich structure comprising the cured dry toner between the first and second substrate will be suitable to be in direct contact with food. Compared to prior art solutions, embodiments of the invention have the advantage that very good printing results can be obtained without the need for applying a coating after printing.

A further object of embodiments of the invention may be to avoid the need for multiple stations/steps to achieve good results. By applying the curing immediately after the fusing and the applying of the second substrate, whilst the dry toner is still at a temperature above the glass transition temperature Tg, one integrated station can perform the method in a single integrated step. Indeed, the applying and bonding of the second substrate are integrated with the printing, such that a "one step" printing and bonding process is obtained.

In an exemplary embodiment the curable transferred dry toner on the first substrate is composed of an electron beam-curable dry toner, and the irradiating step comprises irradiating the dry toner with electron beams. The advantage of using electron beams is that the electron beams can penetrate over a certain depth in the layer to be cured. Further, using electron beams has the advantage that it is not necessary to include a photo-initiator in the dry toner which makes the migration issue somewhat less complex. Alternatively a UV curable dry toner may be used. However, for some applications using UV is not possible, e.g. when the substrates are not permeable for the right wavelength (e.g. metallized substrates). The irradiating may be done through the second substrate and/or through the first substrate. If the irradiating is done through the second substrate, in that case preferably a thin foil, the electron beams can penetrate through the second substrate.

In an exemplary embodiment the second substrate is provided with an adhesive layer on a face thereof facing the first substrate. In that manner a good adherence, both on the image locations and the non-image locations can be guaranteed. The adhesive layer may be a layer which is dry at room temperature and which is caused to bond to the first substrate by applying heat, e.g. during the fusing; and/or by actinic radiation or particle beams, e.g. during the curing step. In such embodiment the fusing and/or curing step for fusing/curing the dry toner may be advantageously used to also cause the bonding. In such an embodiment the fusing is preferably done during and/or shortly after the applying of the second substrate.

Alternatively or additionally the first substrate is provided with an adhesive layer on a face thereof where the dry toner is transferred. In such an embodiment the fusing is preferably done before and/or during the applying of the second substrate.

The adhesive layer is preferably provided across the entire surface of the first and/or second substrate, i.e. non-image-wise, wherein a more or less even layer of adhesive may be applied on the first and/or second substrate. In another embodiment the adhesive layer may be applied image-wise, i.e. adhesive may be applied according to a pattern on the first substrate and/or the second substrate, e.g. according to a pattern which is complementary to the pattern associated with the latent image, for example by an inkjet head. The image-wise addition of adhesive may be advantageous especially on the non-image parts where no curable dry toner is present.

In an exemplary embodiment a clear toner may be applied according to a pattern on the first substrate and/or on the second substrate, e.g. according to a pattern which is complementary to the pattern associated with the latent image. In that manner the toner layers can be brought to a substantially equal thickness. This can be done by using a station with clear curable toner to be applied in a negative way compared to the coloured image, i.e. the pattern associated with the latent image. Also, when thin first and/or second substrates are being used it could be useful to apply a clear dry toner image layer complementary to the coloured image so that the second substrate material does not have to overcome high differences in height between image parts and none-image parts. Such a solution may allow to work with substrates that do no comprise an adhesive layer. This solution may be particularly advantageous when the coverage of the coloured image is high such that only a limited amount of clear toner is needed.

According to an exemplary embodiment the irradiating is done in line with the fusing, wherein a distance measured on the first substrate between a fusing location and an irradiating location is less than 0.7 m, preferably less than 0.55 m, more preferably less than 0.40 m. Typically, the first substrate moves from the fusing location to the irradiating location at a speed which is higher than 16 cm/s, preferably higher than 32 cm/s. In that manner the dry toner which is heated during the fusing step is still at a temperature above Tg which is sufficiently high to obtain good curing results. More in particular the fusing and curing may be done in line, such that the temperature of the dry toner during curing is higher than the glass transition temperature Tg thereof, preferably larger than Tg+15° C., more preferably larger than Tg+30° C.

According to an exemplary embodiment the fusing is done during the applying of the second substrate by applying a heated rotating member, in particular a fusing roller, against the second and/or first substrate such that the second or first substrate is pressed against the first or second substrate. In that manner the fusing can be done with contacting the dry toner such that the maintenance and use of the apparatus can be limited and the lifetime of the fuser can be enhanced. Further, the heated rotating member and the simultaneously applied pressure may help to obtain a good bonding between the first and the second substrate.

In an exemplary embodiment the first and/or the second substrate are transparent. By using a transparent first and/or second substrate, the transparent first and/or the second substrate can be given suitable properties to improve the print result. In a possible embodiment the second substrate is transparent, and the irradiating takes place through the second substrate. In another embodiment the first substrate is transparent, and the irradiating takes place through the first substrate. In yet another embodiment the first and second substrate may be transparent and/or the irradiating may take place through the first and second substrate. In case both substrates are transparent and if UV light is used, preferably the irradiation takes place through the substrate which is most transparent to the wavelength of the UV light which is used.

In an exemplary embodiment the second substrate and dry toner are selected such that the second substrate adheres to the cured dry toner after the irradiating step and such that the second substrate is bonded to the first substrate. More in particular, the adhesive layer may be configured such that it adheres well to both the first substrate and the dry toner transferred thereon. For example, a thin plastic foil, e.g. a PE, PP or polyester foil may be selected as the second substrate. Such a thin foil may be provided with an adhesive layer, e.g. a PE layer with suitable properties obtained by adding certain copolymers to the PE material, a curable or non curable polyurethane coating layer, a curable or non curable hot-melt layer, etc.

In an exemplary embodiment the first or the second substrate is non-transparent and irradiating takes place through the first and/or the second substrate. The non-transparent substrate can be for instance a metallic film in order to obtain advantageous print properties/effects of the final print. Especially for flexible packaging materials, such metallic films are often used. More generally, because electron beam curing can also be done through non-transparent substrates, a higher flexibility in the choice of the first and second substrate is provided.

If the printability for example is better on a transparent substrate one can print in reverse/mirror mode on the transparent first substrate, and use a non-transparent substrate as the second substrate, such that the image is visible through the first substrate.

In other possible embodiments the first substrate and the second substrate may be non-transparent, and the second or first substrate may be partially or fully removed after printing. However, of course the first and/or the second substrate may also be transparent in this case. If the first substrate is removed, printing is done in the reverse/mirror mode, while printing can be done in the normal mode if the second substrate is removed.

When the second substrate is removed the surface pattern or the surface roughness on a side thereof that is in contact with the toner layer can be used to control the gloss level on the final printed product (going e.g. from matt to satin and high gloss). Similarly, when the first substrate is removed, the side thereof on which the toner layer is provided may be provided with a suitable surface pattern or surface roughness to obtain a desired gloss level on the final printed product. In other words, in embodiments of the invention the surface roughness or surface pattern of the first or second substrate may be chosen to obtain a desired gloss level in the printed product. For example, when a high gloss is desirable a smooth surface can be chosen for the substrate that is removed. When a matt result is desirable a surface with a determined degree of surface roughness can be chosen for the substrate that is removed. Such embodiments may be useful e.g. in cases where the substrate to be removed does not comprise an adhesive layer and/or in cases where clear toner is used such that the entire surface is covered with toner.

In an exemplary embodiment the irradiating is done through the second substrate and/or first substrate. The substrate with the best printability is preferably used as the first substrate. In exemplary embodiments the curing may take place at the same distance from the fusing means simultaneously at both sides of the sandwich structure. If UV light is used for curing, it is then preferred that the UV sources used for curing are designed in such way that the UV sources are not damaged or heated up by the UV light going through both the first and the second substrate.

In an exemplary embodiment the first substrate and the second substrate are provided as a continuous web during printing; and, during printing, the development member and the imaging member rotate continuously.

In an exemplary embodiment the first substrate and/or the second substrate comprises any one of the following: plastic film, metallic film, thermal paper, paper, and combinations thereof. The first and/or second substrate may have a multilayer structure. For example, the first or second substrate may be a substrate used for label printing. Examples of first substrates are plastic or metallic films. Suitable plastics are e.g. polyvinyl chloride (PVC), polyvinylidene chloride (PVDC), polyester, polycarbonates, polyvinyl acetate, polyolefins and particularly polyethylenes (PE), like polyethylene of high density (HDPE), polyethylene of middle density (MDPE), linear polyethylene-middle density (LMDPE), polyethylene low-density (LDPE), linear low density polyethylene (LLDPE), and (biaxially oriented) polypropylene (PP). Examples of metallic films are foils containing any one of the following or a combination thereof: iron, steel, copper, aluminium and its alloys. Preferably a metallic film comprises a polymer film, e.g. a PP or PET film, coated with a thin layer of metal, preferably aluminium. Such metallic films offer the glossy metallic appearance of an aluminium foil at a reduced weight and cost. The second substrate may be e.g. a polymer foil or metallic foils. Examples of suitable plastic foils are: PE foils, PP foils, polyester foils, etc. It is noted that it can also be envisaged to print on a thin foil as the first substrate, and to apply a thicker second substrate, wherein the irradiating then preferably takes place through the first substrate. However, in a possible embodiment the irradiating is done through the second substrate, and the second substrate is a plastic foil or metallic foil with a thickness between 10 and 75 micron and more preferably between 15 and 50 micron.

Preferably the first and/or the second substrate comprises a base layer and an adhesive layer, wherein the base layer may be a polymer foil provided with a suitable coating as the adhesive layer. Example of suitable adhesive layers are: a PE, PP or PET layer comprising copolymers configured to cause bonding at a fusing temperature used for the fusing of the curable dry toner, a curable or non curable polymer layer such a curable polyurethane layer, a curable or non curable hot-melt coating, etc. In other embodiment the material of the polymer foil itself may be suitable to achieve a bonding between the first and the second substrate, or, in case a transparent curable toner has been applied, an adhesion to the curable toner layer.

In an exemplary embodiment the dry toner is transferred from the imaging member to the first substrate either directly or via an intermediate member.

According to a second aspect there is provided a digital printing apparatus for xerography printing with curable dry toner. The digital printing apparatus comprises an image forming unit, a second substrate application unit, a fusing means and a curing means. The image forming unit comprises an imaging member adapted to sustain a pattern of electric charge forming a latent image on its surface, a development member arranged to receive dry toner, and to develop said latent image by transferring said dry toner onto said imaging member in accordance with said pattern, wherein the image forming unit is further configured to transfer the dry toner from the imaging member to a first substrate. The second substrate application unit is configured to apply a second substrate on the transferred dry toner on the first substrate. The fusing means is configured to fuse and melt the transferred dry toner before and/or during and/or after the applying of the second substrate. The curing means is located downstream of the second substrate application unit, and the curing means is configured to irradiate the transferred and fused dry toner with actinic radiation or to expose the transferred and fused dry toner to particle beams, in order to cure the dry toner.

The technical advantages explained above for embodiments of the method apply mutatis mutandis for embodiments of the apparatus.

According to a preferred embodiment, the curing means are arranged downstream of the fusing means such that a distance measured on the first substrate between the fusing means and the curing means is less than 0.70 m, preferably less than 0.55 m, more preferably less than 0.40 m. Preferably, the apparatus is configured to move the first substrate from the fusing means to the curing means at a speed which is higher than 16 cm/s, more preferably higher than 32 cm/s. Optionally the fusing means and the curing means may be integrated in one unit. However in other embodiments the fusing means may be integrated with the second substrate application means or may be provided downstream of the second substrate application means. In an exemplary embodiment the fusing means is integrated with the second substrate application unit and comprises a heated rotating member, e.g. a fusing roller, to apply the second substrate against the first substrate.

Preferably, the curing means are arranged directly downstream of the fusing means to avoid that the temperature of the dry toner decreases too much. Preferably, the temperature of the transferred dry toner during curing is still larger than the glass transition temperature Tg thereof, preferably larger than Tg+15° C., more preferably larger than Tg+30° C.

It could be that due to certain architectural considerations or circumstances this heat condition prior to curing is established at a distance larger than the distance mentioned above and that additional heating is applied prior to curing or that the IR heat of the UV light source is used to heat the sandwich structure above the glass transition temperature.

According to an embodiment the curing means may be arranged in a separate curing station at a distance of the fusing means. In that case the curing station may further comprise a heating means configured to heat the sandwich structure before curing. Preferably the heating means are configured to heat the sandwich structure up to a temperature above the glass transition temperature of the dry toner.

In a preferred embodiment the second substrate application unit is configured to apply a second substrate comprising a base layer and an adhesive layer facing the first substrate. Preferably the adhesive layer is a layer which is dry to the touch in normal storage conditions and which bonds to the first substrate during the applying of the second substrate layer or during the fusing or during the curing. Typically the adhesive layer is a layer which is applied beforehand; substrates comprising such an adhesive layer are readily commercially available. However, in other exemplary embodiments the apparatus may comprise a coating station for applying adhesive on the second substrate upstream of the second substrate application unit, i.e. for applying adhesive on the second substrate before the second substrate is applied on the first substrate and such that the side with adhesive is brought in contact with the transferred dry toner on the first substrate. The coating station can be configured to add the adhesive image-wise, e.g. according to a pattern that is complementary to the pattern used by the image forming unit, or non-image-wise, e.g. as an even layer. The coating station may comprise for example an anilox roller and/or one or more inkjet heads. The inkjet heads may be configured to apply adhesive according to a controllable pattern, e.g. according to a pattern that is complementary to the pattern used by the image forming unit. The coating station may then comprises a controller configured to receive image data about the image to be printed by the image forming unit, and to control the inkjet heads based on the received image data.

In an exemplary embodiment the apparatus further comprises a first substrate feeding means configured to feed the first substrate as a continuous web during printing, and the second substrate application unit is configured to apply the second substrate as a continuous web during printing. Also, the development member and the imaging member are preferably configured to rotate continuously during printing.

In an exemplary embodiment the apparatus further comprises a winding means configured for winding the resulting first substrate with the cured dry toner and applied second substrate. Such an embodiment may potentially yield a fully functional high performing safe flexible packaging material that can be used safely for food materials.

In an exemplary embodiment the image forming unit is further configured to transfer clear toner on the first substrate according to a pattern which is complementary to the pattern associated with the latent image. and/or the apparatus further comprises an additional image forming unit configured to transfer clear toner on the first and/or second substrate, upstream of the second substrate application unit.

In another exemplary embodiment where the second substrate is removed after curing, the apparatus further comprises a removal means downstream of the curing means, and a winding means downstream of the curing means, said removal means being configured to remove the second substrate after curing, and said winding means being configured for winding the first substrate with the cured dry toner after said removal. Preferably, the removal means comprises a reel spool for winding the removed second substrate. In that manner the second substrate can be re-used a number of times.

In another exemplary embodiment where the first substrate or a layer thereof is removed after curing, the apparatus further comprises a removal means downstream of the curing means, and a winding means downstream of the curing means, said removal means being configured to remove the first substrate or a layer thereof after curing, and said winding means being configured for winding the second substrate with the cured dry toner after said removal. Preferably, the removal means comprises a reel spool for winding the removed first substrate or the removed layer thereof.

In an exemplary embodiment the first substrate feeding means and/or the second substrate application unit comprises a spool reel with a substrate comprising any one of the following: plastic film, metallic film, thermal paper, paper and combinations thereof.

Preferably, the curing means is an electron beam curing means or a UV source.

In an exemplary embodiment the image forming unit is configured to transfer the dry toner from the imaging member to the first substrate either directly or via an intermediate member.

BRIEF DESCRIPTION OF THE FIGURES

The accompanying drawings are used to illustrate presently preferred non-limiting exemplary embodiments of devices of the present invention. The above and other advantages of the features and objects of the invention will become more apparent and the invention will be better understood from the following detailed description when read in conjunction with the accompanying drawings, in which.

DESCRIPTION OF EMBODIMENTS

Figure 1:
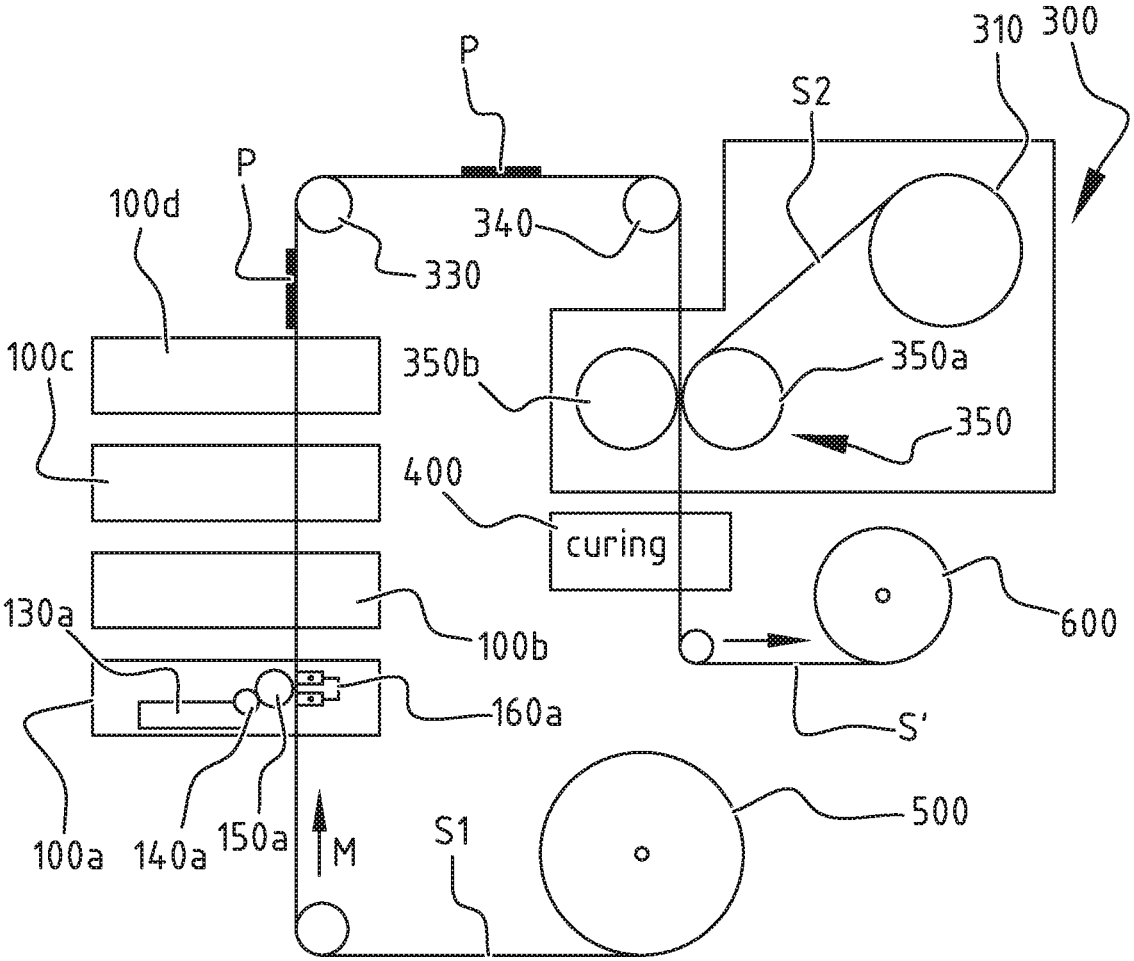
FIG. 1 is block diagram of an exemplary embodiment of a digital printing apparatus.

In electrophotographic processes operating with dry toner, the dry toner comprises radiation curable resin material and a coloring agent such as a pigment. The radiation curable resin material is composed of one or more radiation curable resins. The radiation curable resin material may be a UV-light curable resin material, or another radiation curable resin material, e.g. an electron-beam curable resin material. The radiation curable resin material may be a mixture of one or more radiation curable resins. Further, the radiation curable resin material may be mixed with a non-radiation curable resin material comprising one or more non-radiation curable resins. In that case, the weight percent of radiation curable resin material with respect to the total amount of resin material (i.e. the sum of the radiation curable resin material and non-radiation curable resin material) is preferably higher than 85 weight %, more preferably higher than 90 weight %, and most preferably more than 95 weight %. Useful UV curable resins are resins based on (meth)acryloyl containing polyester. The term polyester includes all polymers with a backbone structure based on a polycondensation of an alcohol, preferably one or more polyols having 2 to 5 hydroxyl groups, and a carboxylic acid-containing compound. Examples of such UV curable resins are unsaturated polyesters based on terephthalic and/or isophthalic acid as the carboxylic acid-containing component, and on neopentylglycol and/or trimethylolpropane as the polyol component and whereon afterwards an epoxy-acrylate such as glycidyl (meth)acrylate may be attached. Another UV curable resin is a polyester-urethane acrylate polymer which may be obtained by the reaction of a hydroxyl-containing polyester, a polyisocyanate and a hydroxy-acrylate. Another useful curable resin material is composed of a mixture of an unsaturated polyester resin in which maleic acid or fumaric acid is incorporated and a polyurethane containing a vinyl ether. If a non-radiation curable resin material is included, the weight percentage of the non-radiation curable resin material is preferably less than 5 weight % of the total resin amount. The non-radiation curable resin material may contain one or more of the following resins: poly condensation polymers (e.g. polyesters, polyamides, co(polyester/polyamides), etc), epoxy resins, addition polymers. The radiation curable resin is preferably BPA free.

For example, the radiation curable resin material may be a resin material comprising a blend of a (meth)acrylated polyester resin and a meth(acrylated) polyurethane resin. Preferably, the milli-equivalent amount of double bounds per gram of said radiation curable resin is more than 0.5 meq/g, more preferably more than 0.7 meq/g.

In addition to the radiation curable resin material, the prepared toner particles may comprise any one or more of the following: a photo-initiator, a wax, a thermal initiator, a flowability improving agent, a charging agent, a filler, etc.

The use of curable toner has the advantage that the internal cohesive strength of the toner layer after curing is higher compared to a non curable toner. Without being limit to any theory the hypothesis is that due to the crosslinking of the toner layer the cohesive strength of a toner layer can be significantly increased. The internal cohesive strength of a toner layer can be seen as the resistance to a split in the toner layer itself (and not the resistance to detach from the first or second substrate).

When starting with a resin with a higher molecular weight or a resin that is (slightly) crosslinked the internal cohesive strength can be improved but the viscosity of the toner will increase and thus the fusing of the toner will become more critical resulting in limitations of substrates that can be printed on. Therefore the use of a low viscous curable toner results in a broad fusing window on many different substrates and a high cohesive strength after curing. The use of BPA as a monomer constituent also helps in this internal cohesion aspect, but the presence of this monomer or chemical alikes is not tolerated anymore in food packaging applications. Embodiments of the invention can solve this problem by curing a BPA free curable dry toner in accordance with embodiments of the invention.

In the present invention, the term "radiation curable" refers to curable by actinic radiation or by a particle beam. The term "actinic radiation" is understood to cover any kind of radiation that can induce a cross-linking reaction in the toner particles after coalescence. In the invention, suitable actinic radiation includes IR-radiation, visible light, UV-light and γ-radiation. Suitable particle beams include electron beams.

FIG. 1 illustrates schematically an exemplary embodiment of a digital printing apparatus using dry toner. The apparatus comprises a first image forming unit 100*a* for applying dry toner Ta having a first colour, e.g. black, onto a first substrate S1, a second image forming unit 100*b* for applying dry toner having a second colour, e.g. cyan, onto the first substrate S1, a third image forming unit 100*c* for applying dry toner having a third colour, e.g. magenta, onto the first substrate S1, and a fourth image forming unit 100*d* for applying dry toner having a fourth colour, e.g. yellow, onto the first substrate S1.

The first image forming unit 100*a* comprises a mixing device 130*a*, a first development member 140*a*, a first imaging member (also called photoconductor member) 150*a*, and a transfer corona 160*a*. The first imaging member 150*a* is adapted to sustain a first pattern of electric charge forming a first latent image on its surface. The first development member 140*a* is arranged to receive mixed first dry toner from the mixing device 130*a*, and to develop said first latent image by transferring a portion of said first dry toner Ta onto first imaging member 150*a* in accordance with said first pattern. Similarly, the second image forming unit 100*b* comprises a second development member and a second imaging member. The second imaging member is adapted to sustain a second pattern of electric charge forming a second latent image on its surface. The second development member is arranged to receive second dry toner, and to develop said second latent image by transferring a portion of said second dry toner onto second imaging member in accordance with said second pattern. The third and fourth imaging member 100*c*, 100*d* may be implemented in a similar manner.

The first substrate S1 is supported on a substrate support assembly (not shown) for supporting the first substrate S1 during the subsequent transfer of first, second, third and fourth dry toner from the first, second, third and fourth image forming unit 100*a*, 100*b*, 100*c*, 100*d*, respectively, whilst the first substrate S1 moves in a movement direction M from the first image forming unit 100*a* to the fourth image forming unit 100*d*. In the development stage, dry toner particles travel from the development member 140*a* onto the imaging member 150*a* that carries the first latent image. In the transfer step, the developed image is transferred from the imaging member 150*a* onto the first substrate S1 e.g. using transfer coronas 160*a*. Similar development stages apply for the second, third and fourth image forming units 100*b*, 100*c*, 100*d*.

Throughout the application, the some stages of the image forming units 100*a*, 100*b*, 100*c*, 100*d* have been described as members. These members may be rotating rollers, but the skilled person will appreciate that the same principles may be applied with other members, e.g. comprising a suitably designed rotating belt with a roll and/or a belt tracking shoe.

The digital printing apparatus further comprises a second substrate application unit 300 configured to apply a second substrate S2, e.g. a foil, on the transferred dry toner on the first substrate S1, a fusing means 350 configured to fuse the transferred dry toner, and a curing means 400 configured to irradiate the transferred dry toner through said second substrate S2 and/or through the first substrate S1 with actinic radiation or particle beams to cure the transferred dry toner. In the embodiment the fusing means 350 are integrated in the second substrate application unit 300, e.g. by using a pair of rolls comprising a fuser roll 350*a* and an optionally heated backing roll 350*b*. It is noted that further heating members may be provided downstream and/or upstream of the fusing means 350. For example, roll 330 and/or 340 may be heated to heat the backside of the first substrate S1 between the image forming unit 100*d* and the second substrate application unit 300. The fusing means 350 perform a fusing step downstream of the image forming units 100*a*, 100*b*, 100*c*, 100*d*, to heat the dry toner particles to a temperature above Tg which is advantageous for the performing of a good curing by the curing means 400. Further the fusing step may enhance the mixing of imaging particles of different colors.

The fusing means 350 may also function to cause a bonding of the second substrate S2 to the first substrate S1. When the fusing means are not integrated in the second substrate application unit 300 (see also FIG. 4 and the discussion below), the second substrate application unit 300 may still comprise a pair of rolls 350*a*, 350*b* to bond the second substrate S2 to the first substrate S1, e.g. by pressure and/or heat.

The second substrate S2 may be provided with an adhesive layer (see also FIG. 3A) facing the first substrate S1 in order to improve the bonding of the second substrate S2 to the first substrate S1. Alternatively or in addition first substrate S1 may be provided with an adhesive layer (see also FIG. 3B) facing the second substrate S2 in order to improve the bonding of the second substrate S2 to the first substrate S1.

It is noted that the first substrate S1 and/or the second substrate S2 may be transparent. For example, the first substrate S1 may be a non-transparent substrate and the second substrate S2 may be a transparent film. In this example the irradiating is preferably done through the second substrate S2. However, it is also possible to print on a thin transparent first substrate S1 and to irradiate through the first substrate S1. In such an embodiment the second substrate S2 may be non-transparent. In yet another embodiment the first substrate S1 may be a transparent substrate, and the second substrate S2 may be a non-transparent substrate, i.e. non-transparent for visible light but transparent for the radiation of electron beams used.

Figure 3A:
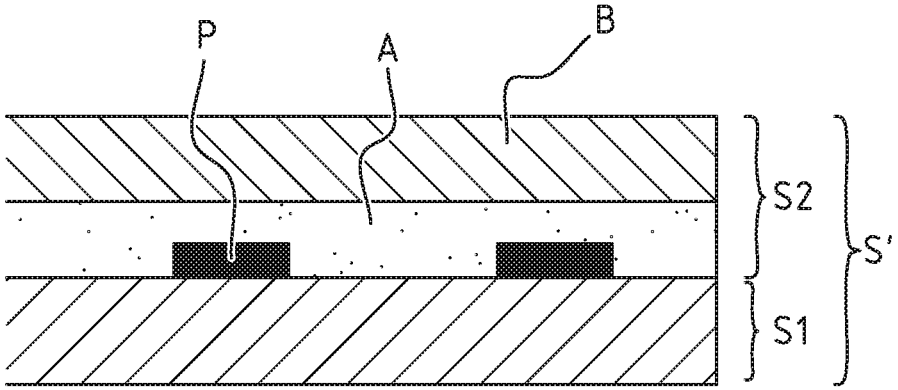
FIGS. 3A-3C illustrate schematically three cross sections of three possible combined substrate structures S' obtained with embodiments of the digital printing method.
Figure 3B:
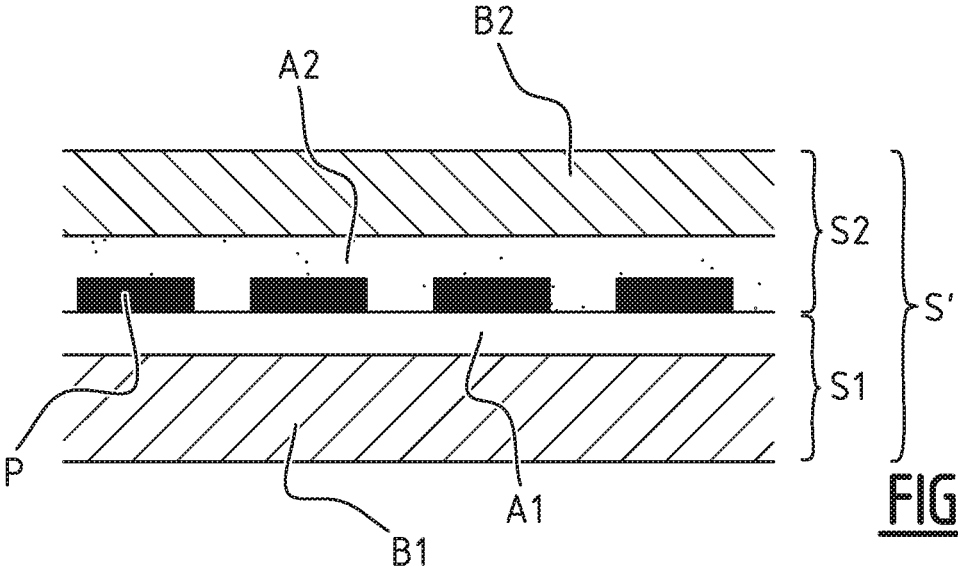

The second substrate application unit 300 is arranged downstream of the image forming units 100*a*, 100*b*, 100*c*, 100*d*. FIG. 3A shows schematically the second substrate S2 comprising a base layer B and an adhesive layer A applied on a first substrate S1 on which dry toner particles P has been applied. Applying the second substrate S2 may cause a slight smoothening of the upper surface of the dry toner particles P. In the example of FIG. 3B both the first and second substrate S1, S2 comprise a base layer B1, B2 and an adhesive layer A1, A2.

The curing means 400 may be an electron beam (EB) curing means. EB penetration depends amongst others upon the mass density and thickness of the material. EB curing has the advantage that electrons are substantially "color blind" and that penetration is not affected by pigments and opaque substrates. An EB curing means typically comprises electrically operated filaments and grids contained within a vacuum chamber. The electrons are accelerated through a window/foil structure to reach the area to be cured at atmospheric pressure. In an embodiment of the invention low-voltage EB equipment operating from about 70 to 125 kV may be used for most applications. EB penetration may be controlled by varying the accelerating potential (voltage) of the EB curing means. The effect of the electron beams on the first substrate S1 may in certain embodiments be beneficial. E.g. cross-linking may enhance the properties of some polyethylene based substrates. Also, EB-induced ionization of the substrate surface may result in enhanced adhesion. Electron beams can also potentially be used for simultaneous curing of the dry toner and surface sterilization of the substrates S1, S2. Such embodiments may be useful for food packaging materials.

The curing means 400 may also function to cause or enhance a bonding of the second substrate S2 to the first substrate S1. To that end the adhesive layer of the first and/or second substrate S1, S2 may be a curable adhesive layer.

Other curing means 400 are UV curing systems based on LED and/or (doped) mercury bulb. It is advisable that the absorption spectrum of the used photo-initiator match with the spectrum of the irradiated UV light in order to obtain an as good curing as possible.

Particular embodiments of the invention relate to the field of digital printing apparatus and processes for so-called "continuous" webs, i.e. printing systems where a continuous roll of substrate is run through the printer, in particular to print large numbers of copies of the same image(s), or alternatively, series of images, or even large sets of individually varying images. The digital printing apparatus comprises to that end a first substrate feeding means 500 configured to feed the first substrate S1 as a continuous web during printing. Further the second substrate application unit 300 may be configured to apply the second substrate S2 as a continuous web during printing. The resulting substrate S' with the printed image beneath second substrate S2 may then be rolled on a roll 600.

Figure 2:
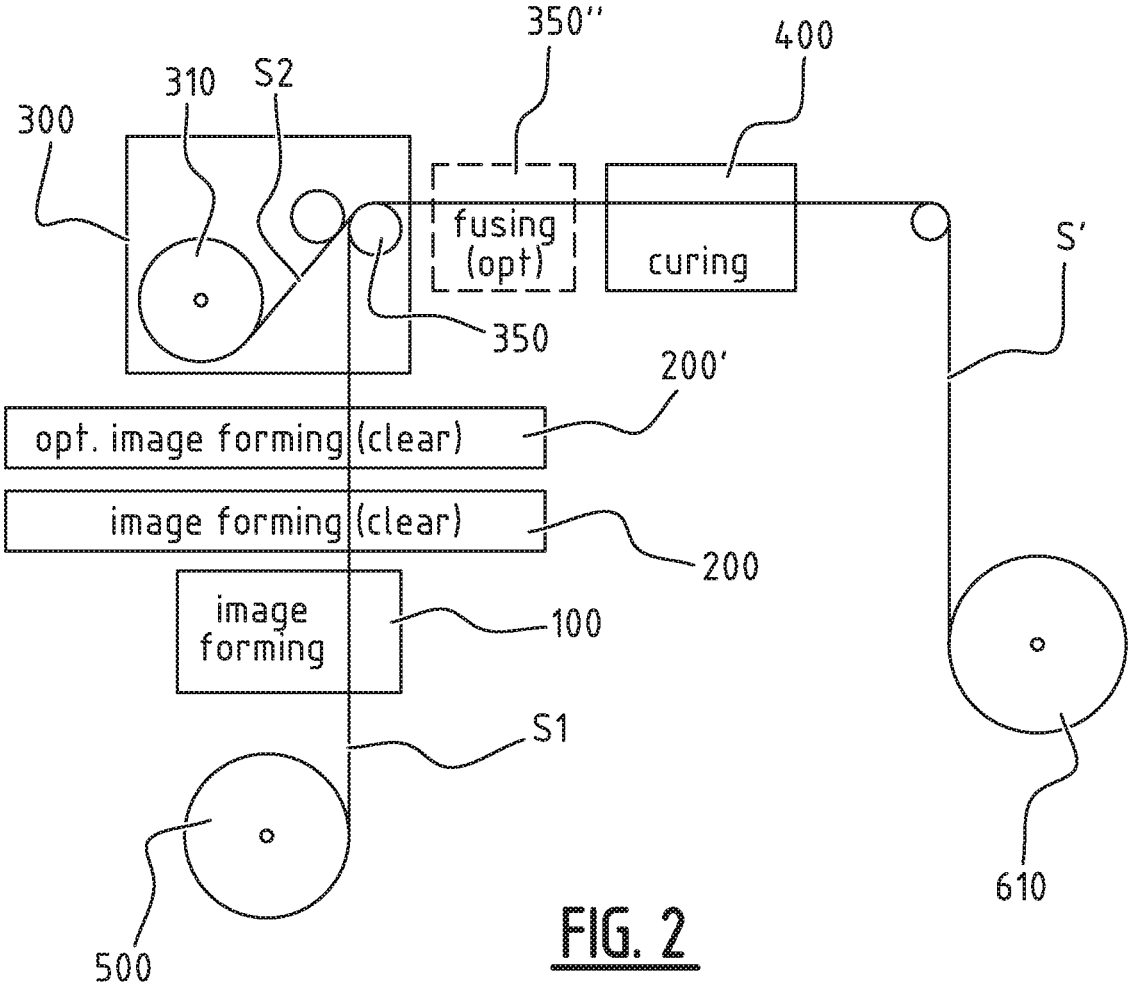
FIG. 2 is block diagram of another exemplary embodiment of a digital printing apparatus.
Figure 3C:
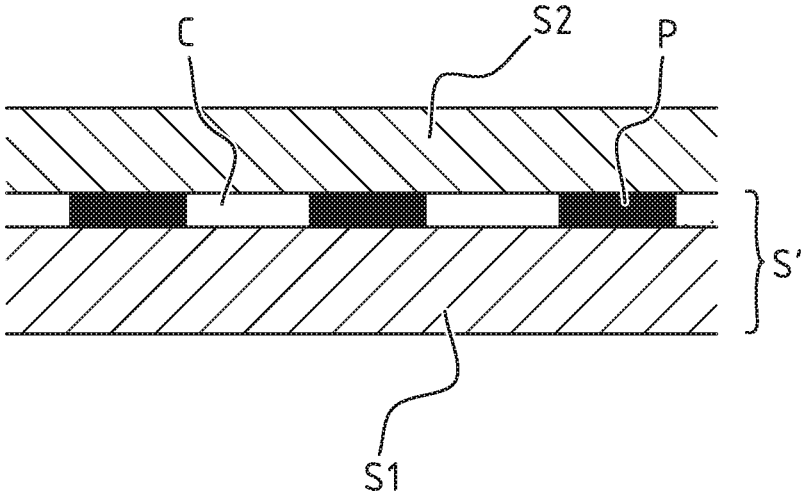

FIG. 2 illustrates another exemplary embodiment of a digital printing apparatus of the invention in which components similar to the components of the embodiment of FIG. 1 have been indicated with the same reference numerals. The digital printing apparatus comprises a first substrate feeding means 500 for feeding a first substrate S1, an image forming unit 100 for forming a printed image by transferring dry toner on the first substrate S1, a second image forming unit 200 to apply curable clear toner to the non image parts of the image, optionally a second image forming unit 200' to apply an additional amount of curable clear toner to have the possibility to adjust the desired amount of clear toner, a second substrate application unit 300 configured to apply a second substrate S2, e.g. a foil, on the transferred dry toner on the first substrate S1, and a curing means 400 configured to irradiate the transferred dry toner through said second substrate S2 and/or through the first substrate S1 with actinic radiation or particle beams to cure the dry toner. A fusing means 350 may be integrated in the second substrate application unit 300, see reference numeral 350. In addition or alternatively there may be provided a fusing means between the image forming unit 200' and the second substrate application unit 300, and/or a fusing means 350" between the second substrate application unit 300 and the curing means 400. The fusing means 350, 350" may function to fuse the dry toner and/or to cause the bonding of the first substrate S1 to the second substrate S2. Such an example is illustrated in FIG. 3C.

Preferably the first substrate S1 comprises any one of the following: plastic film, metallic film, thermal paper, paper, and combinations thereof. The first substrate S1 may also have a multilayer structure. Examples of first substrates are plastic or metallic films. Suitable plastics are e.g. polyvinyl chloride (PVC), polyvinylidene chloride (PVDC), polyester, polycarbonates, polyvinyl acetate, polyolefins and particularly polyethylenes (PE), like polyethylene of high density (HDPE), polyethylene of middle density (MDPE), linear polyethylene-middle density (LMDPE), polyethylene low-density (LDPE), linear low density polyethylene (LLDPE), and (biaxially oriented) polypropylene (PP). Examples of metallic films are foils comprising any one or more of the following: iron, steel, copper, aluminium and its alloys. Preferably, a metallic film comprises a polymer foil on which a metal coating is applied.

In an exemplary embodiment where the second substrate S2 is not removed, the first substrate S1 may be non-transparent and the second substrate S2 may be transparent. However it is also possible to apply a (removable) non-transparent foil as the second substrate S2. If the second substrate S2 has to be transparent, preferably a polymer foil with an adhesive layer is chosen. Examples of suitable plastic foils are: PE foils, PP foils, polyester foils, etc. In such an embodiment the irradiating is preferably done through the second substrate S2, and the second substrate S2 is then preferably thin, e.g. between 15 and 50 micron. Alternatively the printing may be performed on a thin first substrate S1 and the irradiating may be performed through the first substrate S1.

Figure 4:
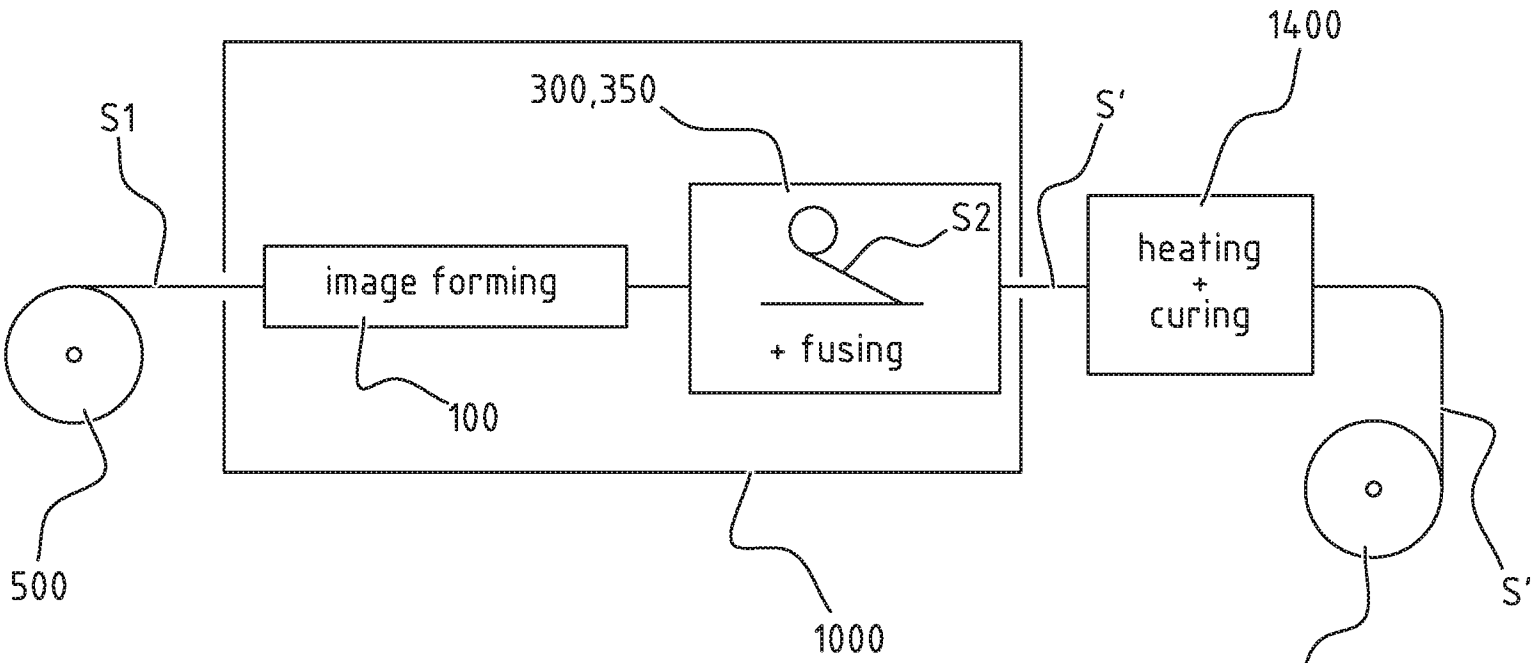
FIG. 4 illustrates a block diagram of another exemplary embodiment of a digital printing apparatus.

FIG. 4 illustrates another exemplary embodiment of a digital printing apparatus of the invention in which components similar to the components of the embodiment of FIGS. 1 and 2 have been indicated with the same reference numerals. The digital printing apparatus comprises a first substrate feeding means 500 for feeding a first substrate S1; a first station 1000 comprising an image forming unit 100 for forming a printed image by transferring dry toner on the first substrate S1 and a second substrate application and fusing unit 300, 350 configured to apply a second substrate S2 on the transferred dry toner on the first substrate S1 and to fuse the transferred dry toner (before, during and/or after the application of the second substrate); and a curing station 1400 comprising a curing means configured to irradiate the transferred dry toner through said second substrate S2 and/or through the first substrate S1 with actinic radiation or particle beams to cure the dry toner, and optionally also a heating means to heat the resulting substrate S' before and/or during curing; and a substrate winding means 600 downstream of the curing means 400, for winding the cured resulting substrate S'. The fusing means may be integrated in the second substrate application unit 300, as explained in connection with FIG. 1. In addition or alternatively there may be provided a fusing means between the image forming unit 100 and the second substrate application unit 300, and/or a fusing means between the second substrate application unit 300 and the curing station 1400. The fusing means 350 may function to fuse the dry toner and/or to cause the bonding of the first substrate S1 to the second substrate S2. Also, the curing station 1400 may function to cure the dry toner and/or to cause or enhance the bonding of the second substrate S2 to the first substrate S1.

As illustrated in FIGS. 3A and 3B, the first and/or the second substrate S1, S2 may comprise a base layer and an adhesive layer. In the example of FIG. 3A, the second substrate S2 comprises an adhesive layer A and a base layer B, while the first substrate S1 may be any desirable substrate that can be bonded through the adhesive layer A of the second substrate S2. The adhesive layer A is preferably a layer which is dry when stored, but which can bond to the first substrate S1 e.g. when heated and/or pressed and/or cured, e.g. when passing through the second substrate application unit 300, and/or through the fusing means 350, 350', 350" and/or through the curing means 400. In the example of FIG. 3B, both the first and the second substrate S1, S2 comprises an adhesive layer A1, A2 and a base layer B1, B2. In that way the adhesive layers A1, A2 may be thinner. The adhesive layer A1 is a layer which is dry when transferring the dry toner particles thereon, but which can bond to the adhesive layer A2 e.g. when heated and/or pressed and/or cured, e.g. when passing through the second substrate application unit 300, and/or through the fusing means 350, 350', 350" and/or through the curing means 400. In yet another example (not illustrated) only the first substrate S1 may be provided with an adhesive layer. In the example of FIG. 3C clear toner C is applied on the non-image parts of the first substrate, whereupon fusing is performed and a second substrate S2 is applied thereon followed by curing.

While the invention has been described hereinabove with reference to specific embodiments and examples, this is done to illustrate and not to limit the invention. The skilled person will appreciate that other ways of implementing the inventive concept described herein are within the scope of the invention, as defined by the accompanying claims.

The invention claimed is:

1. A digital printing process for xerography printing with curable dry toner, wherein said process comprises:

forming a latent image as a pattern of electric charge on a surface of an imaging member;

transferring dry toner onto a development member;

developing the latent image by transferring dry toner from the development member onto the imaging member in accordance with the pattern;

transferring the dry toner from the imaging member to a first substrate;

applying a second substrate on the transferred dry toner, fusing the transferred dry toner, and bonding the second substrate to the first substrate; wherein the fusing is done before and/or during and/or after the applying of the second substrate;

after application of the second substrate, irradiating the dry toner with actinic radiation or particle beams to cure at least the fused transferred dry toner; wherein the irradiating is done after and/or during the fusing, such that the temperature of the dry toner during curing is higher than the glass transition temperature Tg thereof.

2. The process of claim 1, wherein the second substrate is provided with an adhesive layer on a face thereof facing the first substrate.

3. The process of claim 1, wherein the first substrate is provided with an adhesive layer on a face thereof where the dry toner is transferred.

4. The process of claim 1, further comprising applying a clear toner according to a clear toner pattern on the first substrate and/or on the second substrate, said clear toner pattern being such that at least the areas of the first substrate not covered with transferred dry toner, are covered by the clear toner.

5. The process of claim 1, wherein the bonding of the second substrate to the first substrate is caused by heat and/or pressure and/or actinic radiation and/or by particle beams.

6. The process of claim 1, wherein the curable dry toner is an electron beam-curable dry toner, and the irradiating step comprises irradiating the dry toner with electron beams.

7. The process of claim 1, wherein the first and/or the second substrate are transparent.

8. The process of claim 1, wherein the second substrate and the dry toner are selected such that both the first and the second substrate adhere to the cured dry toner after the curing step.

9. The process of claim 1, wherein the irradiating is done in line with the fusing, wherein a distance measured on the first substrate between a fusing location and an irradiating location is less than 0.7 m; and wherein the first substrate moves from the fusing location to the irradiating location at a speed which is higher than 16 emfs.

10. The process of claim 1, wherein the fusing is done during the applying of the second substrate by applying a heated rotating member, comprising a fusing roller, against the second substrate such that the second substrate is pressed against the first substrate.

11. The process of claim 1, wherein the irradiating is done through the second substrate and/or through the first substrate.

12. The process of claim 1, wherein the first substrate and the second substrate are provided as a continuous web during printing; and wherein, during printing, the development member and the imaging member are continuously rotating members.

13. The process of claim 1, wherein the first or second substrate is a plastic foil.

14. A digital printing apparatus for xerography printing with curable dry toner, wherein said apparatus comprises:

an image forming unit comprising an imaging member adapted to sustain a pattern of electric charge forming a latent image on its surface, a development member arranged to receive dry toner, and to develop said latent image by transferring said dry toner onto said imaging member in accordance with said pattern, wherein the image forming unit is further configured to transfer the dry toner from the imaging member to a first substrate;

second substrate application unit configured to apply a second substrate on the transferred dry toner on the first substrate;

a fusing means configured to fuse the transferred dry toner before and/or during and/or after the applying of the second substrate; and a curing means configured to irradiate the transferred dry toner with actinic radiation or particle beams to cure the transferred and fused dry toner;

wherein the curing means are arranged downstream of the fusing means such that a distance measured on the first substrate between the fusing means and the curing means is less than 0.70 m; and wherein the curing means are arranged directly downstream of the fusing means such that the temperature of the transferred dry toner during curing is higher than the glass transition temperature Tg thereof.

15. The apparatus of claim 14, wherein the apparatus is configured to move the first substrate from the fusing means to the curing means at a speed which is higher than 16 emfs.

16. The apparatus of claim 14, wherein the curing means are arranged in a separate curing station downstream of the fusing means, and wherein the curing station is configured for heating the transferred and fused dry toner prior to curing.

17. The apparatus of claim 14, further comprising a first substrate feeding means configured to feed the first substrate as a continuous web during printing, wherein the second substrate application unit is configured to apply the second substrate as a continuous web during printing, and wherein the imaging member and the development member are configured to rotate during printing.

18. A digital printing apparatus for xerography printing with curable dry toner, wherein said apparatus comprises:

an image forming unit comprising an imaging member adapted to sustain a pattern of electric charge forming a latent image on its surface, a development member arranged to receive dry toner, and to develop said latent image by transferring said dry toner onto said imaging member in accordance with said pattern, wherein the image forming unit is further configured to transfer the dry toner from the imaging member to a first substrate;

second substrate application unit configured to apply a second substrate on the transferred dry toner on the first substrate;

a fusing means configured to fuse the transferred dry toner before and/or during and/or after the applying of the second substrate; and a curing means configured to irradiate the transferred dry toner with actinic radiation or particle beams to cure the transferred and fused dry toner;

wherein the second substrate application unit is configured to apply a second substrate which is provided with an adhesive layer facing the first substrate; wherein the fusing means is integrated with the second substrate application unit and comprises a heated rotating member to apply the second substrate against the first substrate; the apparatus optionally further comprising a winding means configured for winding the resulting first substrate with the cured dry toner and applied second substrate; wherein optionally the curing means is an electron beam curing means or a UV source; wherein optionally the first and/or the second substrate are transparent; wherein optionally the image forming unit is further configured to transfer clear toner on the first substrate according to a pattern which is complementary to the pattern associated with the latent image; wherein the apparatus optionally further comprises an additional image forming unit configured to transfer clear toner on the first and/or second substrate, upstream of the second substrate application unit.

* * * * *